US005975527A

United States Patent [19]

Winchester

[11] Patent Number: 5,975,527

[45] Date of Patent: Nov. 2, 1999

[54] PORTABLE SPRING TYPE IMPACT BALL PITCHING DEVICE

[76] Inventor: David A Winchester, 1807 Devonshire Dr. SE., Decatur, Ala. 35601

[21] Appl. No.: 08/782,751

[22] Filed: Jan. 13, 1997

[51] Int. Cl.[6] ..... A63B 71/00

[52] U.S. Cl. ..... 273/129 V; 124/7; 124/36

[58] Field of Search ..... 473/107; 273/129 V; 124/7, 8, 9, 16, 51.1, 36

[56] References Cited

U.S. PATENT DOCUMENTS

| | | | |
|---|---|---|---|
| 1,268,187 | 6/1918 | Velk | 124/7 |
| 2,815,743 | 12/1957 | Brunderman | 124/7 |
| 3,838,677 | 10/1974 | Alvares | 273/129 V |
| 4,237,851 | 12/1980 | Haller | 124/36 |
| 4,254,755 | 3/1981 | Morgan | 124/7 |
| 4,368,885 | 1/1983 | Katada et al. | 124/36 |
| 4,699,378 | 10/1987 | Sung | 124/7 |

FOREIGN PATENT DOCUMENTS 439647 7/1933 United Kingdom .

*Primary Examiner*—Theatrice Brown

[57] ABSTRACT

In a baseball, softball tennis practice ball throwing machine having a spring actuated pivot arm having a ball impact element at a free end thereof and biasing spring elements at its pivot end. A hand crank is attached to a pivot shaft for rotating the arm against the bias of the spring elements. A ball support station is provided to support a ball in the path of the ball impact element to be impacted and projected a distance by the arm as it rapidly rotate about the pivot shaft when under the influence of the biasing spring elements.

4 Claims, 5 Drawing Sheets

PORTABLE SPRING TYPE IMPACT BALL PITCHING DEVICE

BACKGROUND OF THE INVENTION

1. Field of the Invention

The present invention relates in general to sports training devices and in particular to ball pitching machines for practicing baseball and softball batting and fielding skills as well as other sports play involving interaction with pitched balls.

2. Prior Art

The present invention was conceived and developed after the inventor searched to locate and purchase a ball pitching machine suitable for training his 12 year old son for Little League Baseball play. A manually operated pitching device for plastic "polyballs" was located and purchased. This device pitches low weight hollow plastic balls by a spring powered slinging mechanism and proved to be less than desirable for the purpose required because the machine could not effectively pitch the balls over the Little League regulation distance from the pitching mound to home plate, 46 feet, and because the low weight hollow plastic balls de-accelerate in velocity during flight through air much more rapidly than do actual baseballs. The "polyball" pitching machine simply did not produce the desired training for the inventor's son because it did not duplicate the pitching and flight of baseballs as encountered in actual Little League play. Rotating wheel pitching machines were considered, but rejected because of cost and safety considerations along with concerns over the need for an electrical power source at the practice field. The inventor desired and could not locate a manually actuated pitching machine which would deliver soft safety balls of the weight and size of an official Little League Baseball over the fill official distance from the pitching mound across home plate at the velocities and trajectories expected in actual play. An impact pitching mechanism was developed and reduced to practice for this purpose. The device proved to be very fictional and effective as a training aid and has been refined into the invention described here. No other device is known which provides similar service as cost effectively, safely, or conveniently as the present invention.

A number of the presently available ball pitching machines for baseball and softball batting practice employ motorized spinning wheels to throw baseballs and softballs. These spinning wheel machines are very effective, but are quite bulky and expensive compared to the present invention and all require electrical power at the location of operation. The base model of the present invention is manually operated. An optional electric motor powered actuator may be employed with the present invention to allow an athlete to work independently. This feature of the present invention does not require an onsite electrical power outlet because high energy efficiency allows utilization of a battery powered motor for actuation.

Spinning wheel pitching machines transfer kinetic energy to the ball being thrown by griping the ball between two rotating wheels or between a single rotating wheel and a stationary plate. The ball is slung from the spinning wheel apparatus with velocity and spin. The spinning wheel type pitching machines very effectively throw any type of ball including actual hard game balls. The present invention employs impact to transfer kinetic energy into balls being pitched. Only soft resilient practice balls are effectively pitched by the present invention. The inventor considers this limitation to be a positive feature in that user safety is enhanced by the present invention's inability to pitch hard balls which are more likely to cause injury to anyone who might be accidentally struck than are soft resilient practice balls. The present invention is substantially different from all spinning wheel type ball pitching machines by virtue of employing an impact means to pitch a ball instead of the "grab and sling" means employed by rotating wheel ball pitching machines.

Another mechanical ball pitching machine type employs a rotatable pitching lever. The ball being pitched receives kinetic energy from the pitching lever by being pushed around a circular track or griped in a holding device at the outer end of the lever as the lever rotation is rapidly accelerated by force from some type of mechanism, typically a spring device. The ball being pitched is slung from the device when either the slinging lever strikes a mechanical stop or the ball holding device mechanically releases the ball.

The "Spring Type Ball Throwing Machine" of Glover et al U.S. Pat. No. 4,220,130; the "Mechanical Baseball Pitching Machine" of Ponza U.S. Pat. No. 2,792,822; the "Toy Cannon" of Nichols U.S. Pat. No. 1,352,681; the "Mechanical Base Ball Pitcher" of Long U.S. Pat. No. 1,190,565; and the "Catapult For Throwing Projectiles" of McGlashan U.S. Pat. No. 629,044 are all rotating lever slinging type pitching machines. Rotating lever ball slinging pitching machines accelerate both the ball being pitched and the pitching lever simultaneously to pitch the ball. Once the ball is pitched the lever and attached rotating apparatus retain all the kinetic energy that they had before the ball was pitched or lose their energy into the surrounding apparatus and environment by striking a stop. The energy required to pitch a ball by a slinging type pitching machine thus equals the sum of the energy required to accelerate the lever and associated rotating apparatus plus the energy required to accelerate the ball. In an impact type ball pitching machine a striker lever is first accelerated alone. The accelerated lever then strikes a stationary ball and transfers a portion of its kinetic energy into the ball to produce the pitch. The striker lever and associated pitching apparatus of an impact pitching machine can be significantly de-energized upon pitching the ball. If the energy transfer from the striker apparatus into the ball is carried out with high efficiency, as is the case when soft resilient balls are utilized with the present invention, the total amount of energy required to effect a pitch is just slightly greater than the actual kinetic energy carried by the pitched ball. An impact pitching machine can thus be much more energy efficient than a slinging type pitching machine and require significantly less actuation energy and smaller machine components to produce a given pitch.

The present invention differs substantially from all lever slinging type ball pitching machines. Though bearing some resemblance in appearance to these devices, the present invention employs a totally different means to impart kinetic energy into a ball to effect the pitching of that ball. The present invention is more specialized than are the lever slinging type ball pitching machines and by design only works effectively with soft resilient balls. Slinging type pitching machines may be utilized with hard game balls, hollow low weight "polyballs", or the same soft resilient balls employed by the present invention. Slinging type pitching machines do not pitch with the high energy efficiency that the present invention achieves with soft resilient balls and thus require greater actuation energy and a larger apparatus to pitch balls of similar weight with speeds equivalent to that achieved by the present invention.

A number of impact pitching machines have been invented in the past. The "Ball Projectile Machine" of Ridley et al U.S. Pat. No. 4,721,091; the "Spring Type Ball Projecting Device" of Young et al U.S. Pat. No. 4,185,608; the "Portable Ball Throwing Machine With One-Way Clutch" of Haller U.S. Pat. No. 4,237,851; the "Spring Type Apparatus For Projecting Balls" of Andersson U.S. Pat. No. 4,345,577; the "Spring Type Ball Projecting Device" of McGill U.S. Pat. No. 3,841,294; the "Spring Type Projecting Device" of Scott U.S. Pat. No. 3,779,227; the "Projecting Device" of Binks U.S. Pat. No. 2,660,158; the "Ball Projector" of Binks U.S. Pat. No. 2,660,157; the "Toy Machine Gun" of Miller U.S. Pat. No. 1,916,680; the "Ball Throwing Device" of LACOSTE U.S. Pat. No. 1,916,680; the "Missile Projection Device" of Kahler et al U.S. Pat. No. 1,809,708; the "Ball Throwing Device" of LACOSTE U.S. Pat. No. 1,777,976; and the "Toy Machine Gun" of Brown U.S. Pat. No. 1,480,499 all utilize impact by a spring driven striker as the means by which kinetic energy is transferred into projectiles which are then ejected singularly from the device. The present invention utilizes a rotating crankshaft mechanism to store energy by stretching linear tension springs attached to the cranks then rapidly releases that energy into a striker lever and hammer rigidly attached to the crankshaft as the crankshaft rotates over-center allowing the springs to contract and accelerate the rate of rotation. Of the prior art impact ball pitching machines only the "Ball Projectile Machine" of Ridley et al U.S. Pat. No. 4,721,091; the "Spring Type Ball Projecting Device" of Young et al U.S. Pat. No. 4,185,608; and the "Portable Ball Throwing Machine With One-Way Clutch" of Haller U.S. Pat. No. 4,237,851 utilize a rotating crankshaft type mechanism to store energy by stretching a spring then rapidly release that energy into a striker as the crankshaft rotates over-center. The other prior art impact ball pitching machines employ a striker cocking and release action. In some of these devices the striker is pulled or pushed in one direction against a spring then released to recoil in the opposite direction and strike the ball being pitched. In other of these devices the springs are stretched while the striker is held fast then released allowing the spring to rapidly force the striker in the direction required to impact the ball. The present invention is substantially different from all of these non-crankshaft actuated impact pitching devices by virtue of employing a rotating crankshaft mechanism which rotates in one direction carrying the rigidly attached striker lever and hammer.

In the case of the "Spring Type Projecting Device" of Scott U.S. Pat. No. 3,779,227 the striker is a leaf spring which rotates in one direction about an axis and is cocked by engaging a stop at the outer perimeter. The leaf spring of Scott's device flexes as the shaft rotation continues with the outer perimeter of the striker stopped. When the stop is released the flexed leaf spring of Scott's device rapidly straightens and strikes a ball positioned in a holder. The present invention differs substantially from the "Spring Type Projecting Device" of Scott by virtue of the present invention utilizing a crankshaft mechanism and linear coil tension springs instead of a rotating flexing leaf spring striker as employed with Scott's invention.

In each of the three prior art impact type pitching machines which employ a crankshaft mechanism a single friction reducing bushing supports a rotation shaft rigidly attached to one side of a striker. Additionally, in each a single linear tension spring is attached to a pin extending from the side of the striker opposite the side to which the rotation shaft is attached and off-set from the center of the rotation shaft to form a crank. In the case of the "Ball Projectile Machine" of Ridley et al U.S. Pat. No. 4,721,091 the spring attachment pin is located on the striker toward the end of the striker which actually strikes the ball to effect a pitch. In the case of the "Spring Type Ball Projecting Device" of Young et al U.S. Pat. No. 4,185,608 the spring is attached at a location 90 degrees behind the center line of the ball striker. In the case of the "Portable Ball Throwing Machine With One-Way Clutch" of Haller U.S. Pat. No. 4,237,851 the spring is attached on the opposite side of the rotation shaft 180 degrees from the direction in which the striker extends. These differences in spring attachment location relative to the direction in which the striker extends from the rotation shaft are the fundamental differences between these three prior art crankshaft actuated impact ball pitching machines. In the preferred embodiment of the present invention the striker lever extends from the crankshaft in the direction 180 degrees from the direction in which the cranks extend, similar to the arrangement employed in Haller's invention. The present invention is substantially different from the impact type ball pitching inventions of Ridley et al and Young et al on this basis as well as others discussed below.

There are sound reasons for attaching the linear springs to the opposite side of the rotation shaft from the direction in which the striker extends. In the case of the present invention this arrangement allows the ball feeding and holding mechanism to be situated on the opposite side of the striker rotation shaft from the side to which the springs are attached to the enclosure. Components of the pitching mechanism of the present invention are more evenly distributed about the enclosure by this arrangement allowing ease of fabrication and access as well as generally better functionality than would be enjoyed by another arrangement. Additionally and more significantly, by attaching the springs to the crankshaft on the side 180 degrees from the direction in which the striker extends from the crankshaft results in enhanced mass and force balance about the crankshaft axis of rotation which results in improved performance of the pitching mechanism and enhanced durability of the friction reducing support bearings of the crankshaft of the present invention.

Though the present invention attaches the linear springs to the crankshaft of the ball pitching mechanism in the direction 180 degrees from the direction in which the striker extends as does Haller, the present invention differs fundamentally and substantially from Haller's invention as well as Ridley's et al and Young's et al in other areas. To avoid bending and twisting effects on the crankshaft of the present invention, structural symmetry is employed. The striker of the present invention is rigidly attached to the center of the crankshaft directly between two friction reducing bearings which support the crankshaft. Additionally, two linear tension springs are attached to the crankshaft of the present invention at locations evenly spaced and on either side of the striker. For balance, these two linear tension springs are of similar size and characteristic. For improved efficiency and durability the present invention employs friction reducing bearings to attach the linear tension springs to the crankshaft cranks. Additionally, the one-way clutch mechanism of the present invention is an integral part of the striker lever and thus is also situated symmetrically in the mechanism. A clutch pad composed of a resilient material strip is attached to a portion of the inside surface of the enclosure of the present invention along and slightly outside the arc scribed by the outer edge of the striker hammer. A pawl attached to the outer edge of the striker hammer allows the striker lever and hammer to move freely past the resilient clutch pad strip in the direction required to effect a ball pitch. When external actuation force is removed from the crankshaft before the crankshaft rotates over-center the pawl engages the resilient clutch pad strip and stops the crankshaft and attached mechanism from rotating in the opposite direction due to the pull of the springs. The present invention differs substantially and beneficially from all prior art rotating crankshaft linear spring driven impact ball pitching devices by virtue of employing a unique and improved striker lever and hammer mechanism, symmetrically located balanced twin springs, and twin support friction reducing bearing as well as a unique and improved one-way clutch mechanism. All loads and supports other than the actuation lever are symmetrically located with respect to the ball striking mechanism of the present invention. Additionally, the strikers on the three prior art ball pitching machines which employ rotating crankshaft mechanisms are short, blunt, and stiff compared to the present invention. These strikers do not flex and recoil upon impact with the balls being pitched as does the striker of the present invention. The present invention utilizes a relatively long and slender striker lever which by design does flex and recoil slightly during the impact with the ball being pitched. The flex and recoil action of the striker lever of the present invention contributes to the efficiency with which energy is transferred from the pitching mechanism into the ball being pitched by allowing longer contact time between the striker and ball during impact. The time of contact between the striker and ball during impact coupled with the force applied during that period of contact contribute to the energy transfer efficiency from the striker into the ball. The longer the time of contact and the greater the force exerted during that contact then the greater the amount of energy that is transferred. The present invention additionally differs substantially from the three prior art impact ball pitching devices which employ a rotating crankshaft on the basis of utilizing a relatively long slender striker lever which by design flexes and recoils during impact with a ball to enhance the efficiency with which energy is transferred from the striker into the ball.

SUMMARY OF THE INVENTION

The present invention is a portable sports training device which pitches solid soft resilient balls for baseball or softball batting or fielding practice and hollow tennis balls for tennis practice or baseball batting practice. One embodiment of the present invention pitches over-hand for baseball and tennis training. A second embodiment of the present invention pitches under-hand for fast-pitch softball training. Balls are thrown by the present invention by being struck with a hammer device which rotates at the end of a lever which is rigidly connected to the center of a crankshaft. Dual linear tension springs connected symmetrically on both sides of the lever to the cranks of the crankshaft are stretched during 180 degrees of crankshaft rotation. A one-way clutch mechanism allows the crankshaft to rotate in only the appropriate direction required to produce a pitch. When the cranks reach their maximum pull on the springs and the crankshaft rotates over-center the balanced dual springs rapidly contract releasing their energy into the crankshaft accelerating the rate of rotation of the crankshaft with the attached striker lever and hammer. As the crankshaft rapidly rotates due to the pull of the dual springs and just before the springs are fully contracted, the hammer strikes a ball positioned in a holding device. Upon being struck the resilient ball compresses, absorbing kinetic energy from the rotating crankshaft, lever, and hammer. Upon impact with the ball the lever of the striker flexes slightly against the inertia of the ball and the crankshaft slows in rate of rotation as energy is transferred into the ball. The flexed lever then recoils against the ball as the resilient ball itself decompresses and recoils against the striker mechanism as it is accelerated from the surface of the striker hammer. The ball is then projected through the discharge port of the present invention to travel the desired route for training an athlete.

A resilient ball is required to be effectively pitched by the present invention because the pitching means employed depends upon elastic impact dynamics for high efficiency energy transfer from the pitching mechanism into the ball. The compression and recoil cycle of a resilient ball allows the ball to contact the hammer for a longer period of time during impact and thus absorb more energy from the hammer than would a hard non-resilient ball. To further enhance the compression and recoil effect during striker and ball impact the present invention employs a relatively long and slightly flexible striker lever. Additionally, an optional resilient pad may be attached to the striker hammer surface that contacts a ball being struck. This optional resilient pad can further enhance the energy transfer efficiency during impact between the striker and a ball by providing an additional compression and recoil mechanism during a pitch cycle.

To more closely duplicate the flight trajectory of a ball thrown by a human pitcher the present invention imparts spin on the ball being pitched. For the top discharge or over-hand pitching embodiment of the present invention utilized for baseball and tennis practice, the hammer is tilted such that the hammer edge adjacent to the lever leads the outer edge of the hammer as the striker mechanism rotates. In the bottom discharge or under-hand pitching embodiment of the present invention utilized for fast-pitch softball practice, the hammer is very slightly tilted such that the hammer edge adjacent to the lever lags the outer edge of the hammer as the striker mechanism rotates. The hammer tilt in the over-hand pitching embodiment of the present invention imparts a back spin on the balls pitched. The hammer tilt in the under-hand pitching embodiment of the present invention imparts a forward spin on the balls pitched.

Curve pitches may be produced by the present invention by a combination of striker hammer tilt and the addition of a skid pad positioned in the ball discharge path to contact one side of a pitched ball for a period of time as the pitched ball travels out of the discharge port. The side of the ball which contacts the skid pad is slowed in speed relative to the opposite side of the ball thus imparting spin on the ball. The direction of spin imparted on the ball by this method is such that the leading edge of the ball moves toward the skid pad. A skid pad may be positioned in the ball discharge path from the present invention at any angle about the direction of ball travel to produce a great variety of ball spin and pitch characteristics. Soft resilient material with a high coefficient of friction works most effectively for the spin imparting skid pad.

DETAILED DESCRIPTION

Figure 1:
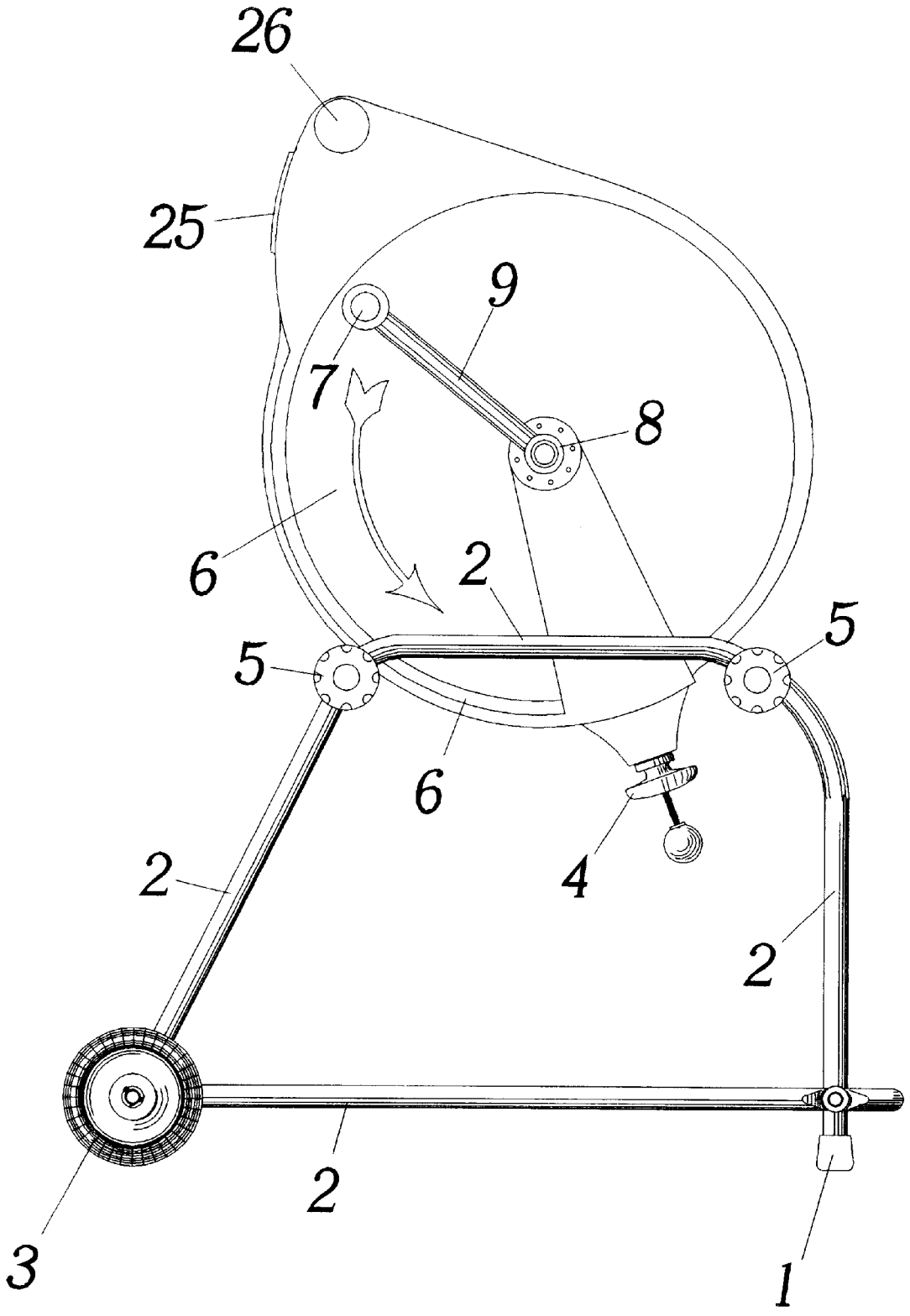
FIG. 1 is a side elevation view of the preferred top discharge embodiment of the present invention for application in baseball or tennis training.
Figure 2:
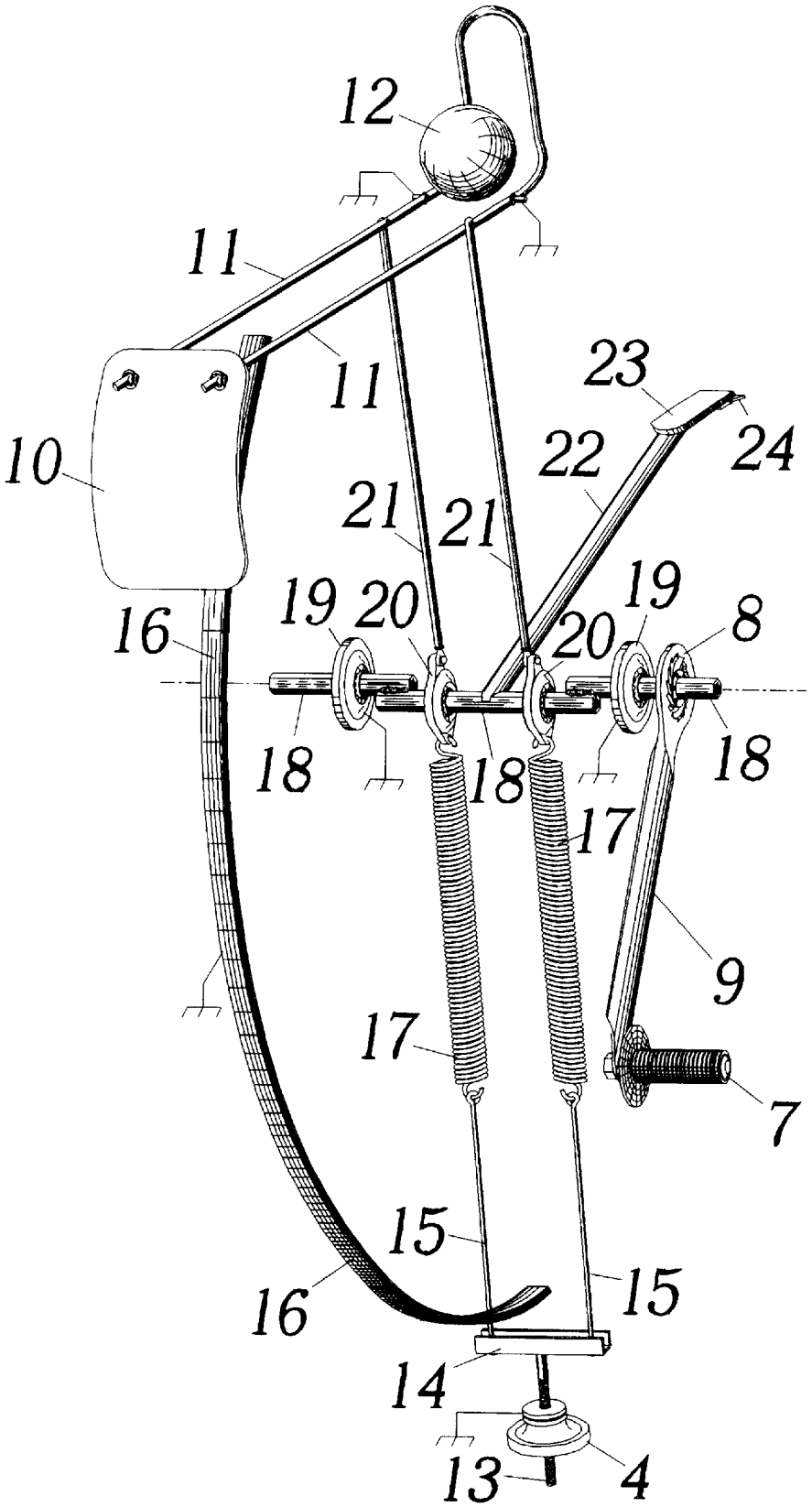
FIG. 2 is an oblique view of the internal mechanism of the manual version of the preferred top discharge embodiment of the present invention as utilized for baseball or tennis training.
Figure 3:
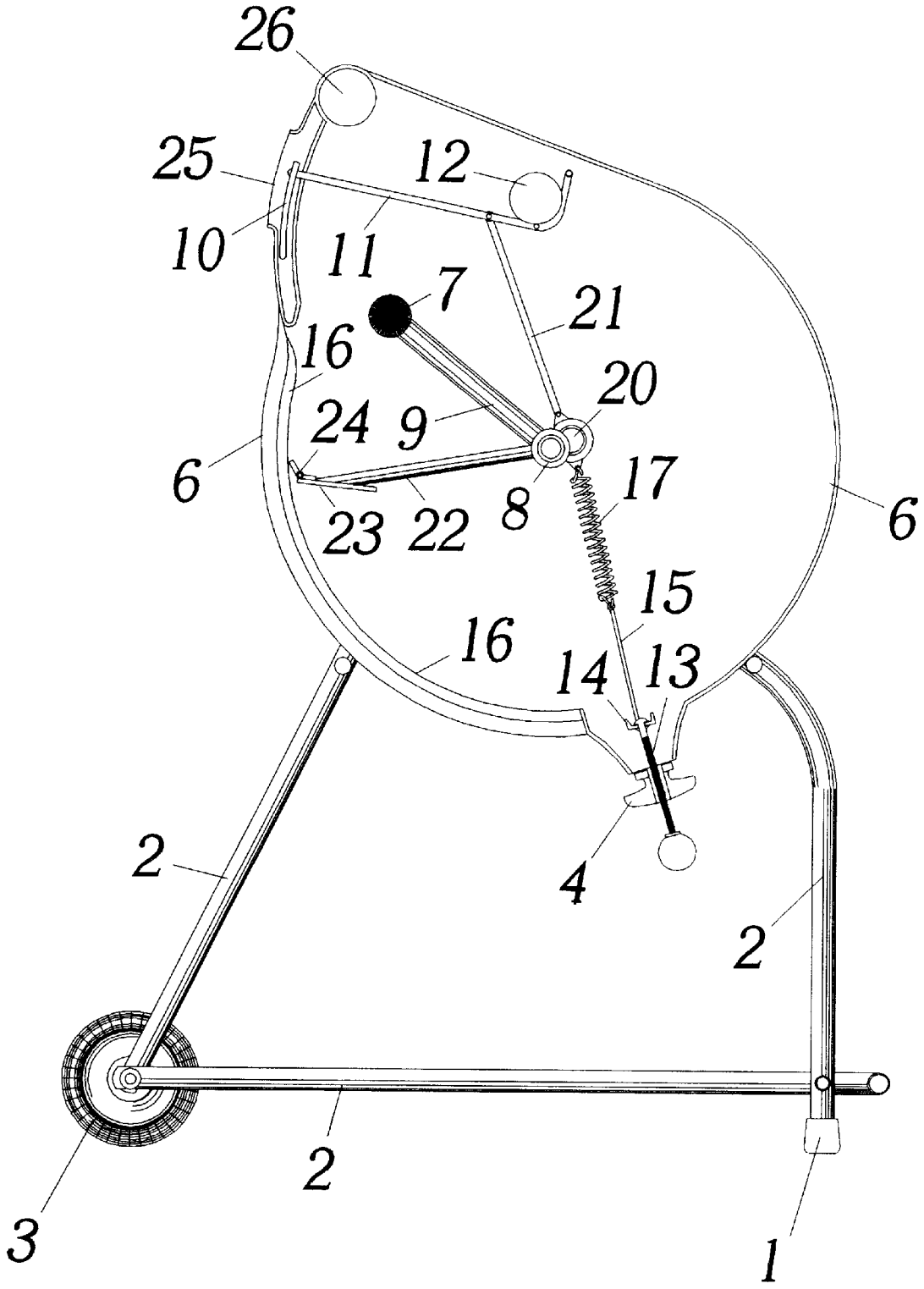
FIG. 3 is a side sectional view of the preferred top discharge or overhand pitching embodiment of the present invention showing the mechanism associated with the enclosure as utilized for baseball or tennis training.
Figure 4:
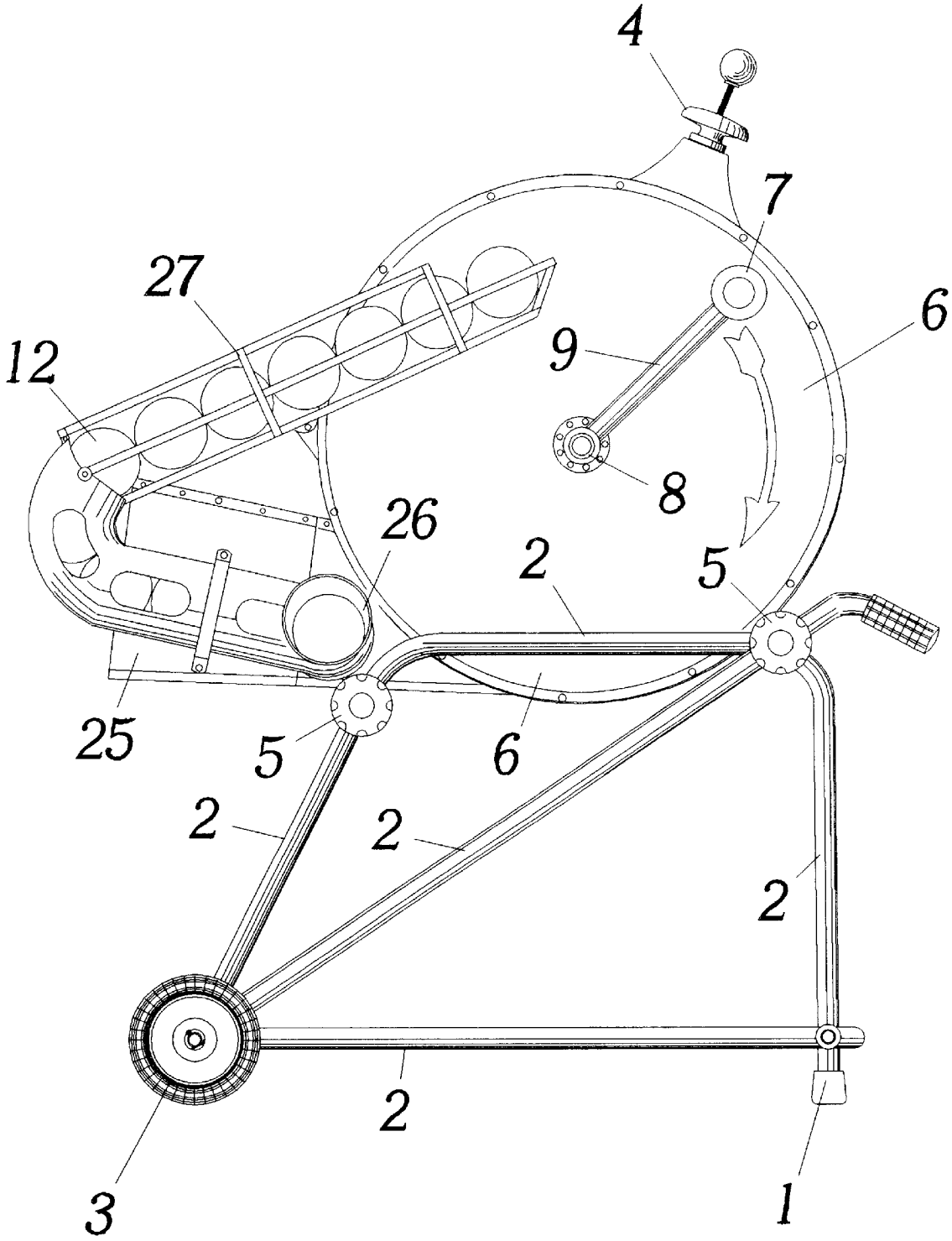
FIG. 4 is a side elevation view of the preferred bottom discharge or underhand pitching embodiment of the present invention as utilized for fast-pitch softball training.
Figure 5:
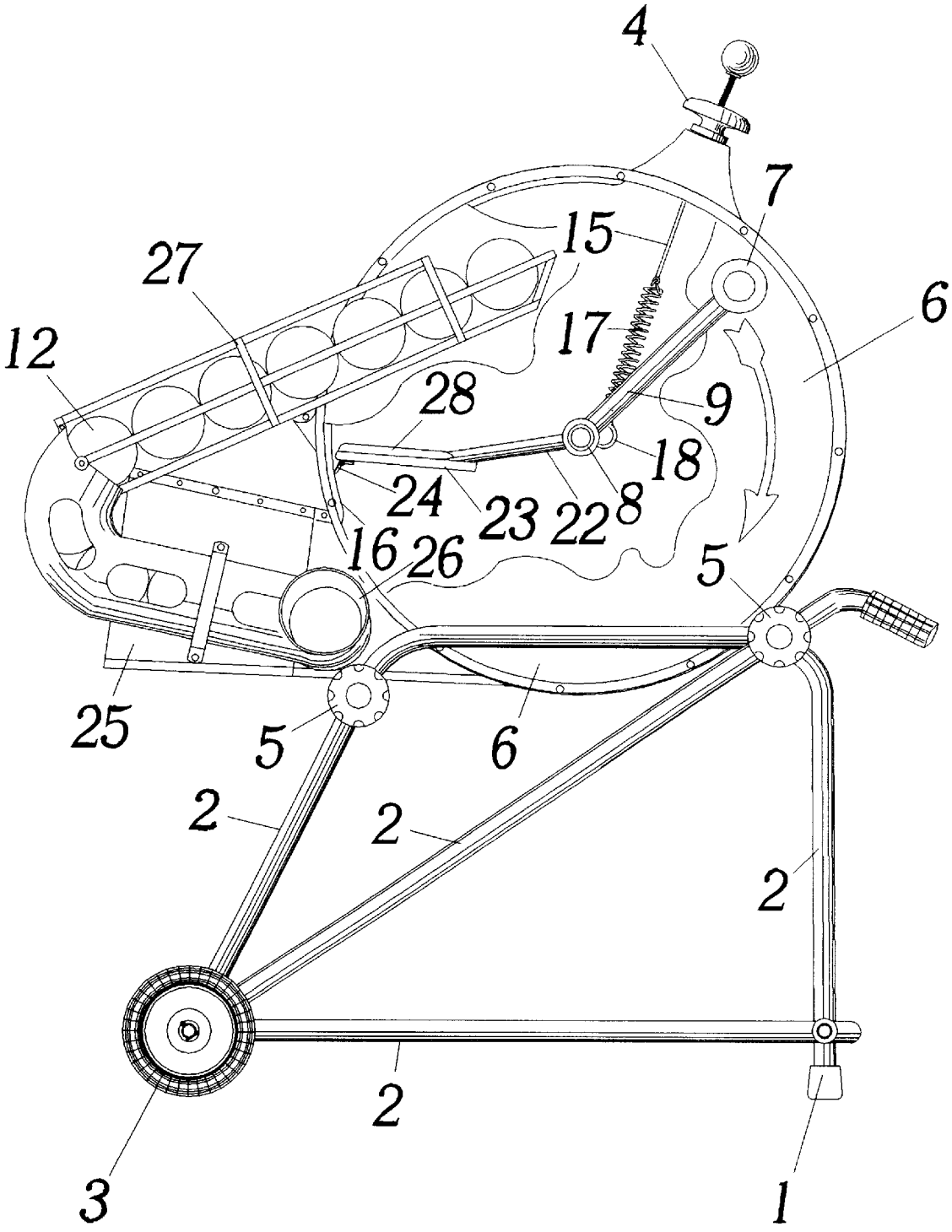
FIG. 5 is a side view of the preferred bottom discharge or under-hand pitching embodiment of the present invention as utilized for fast-pitch softball training with a cut-away view showing the pitching mechanism inside the enclosure or housing.

As shown in the drawings, the present invention provides a portable means for pitching balls for sports training. The present invention is capable of delivering pitched balls of the same mass and size as encountered in actual game play over the full distances and with similar speed, spin, and trajectory as in actual game play for effective sports training. The present invention employs impact as the means by which balls are pitched and by design can only pitch soft resilient safety balls.

The following listing of numbered components shown in the drawings describe their function in the present invention.

1 Foot support for rear edge of portable stand
2 Tubular metal framing comprising a carriage assembly for the pitching device
3 Wheels to facilitate ease of movement over ground and enhance mobility
4 Hand adjustment nut to adjust the tension on the dual springs and thus the ball pitching speed of the present invention
5 Hand adjustment nuts to "clamp" the pitching mechanism and enclosure in support frame and allow adjustment to ball pitch elevation angle
6 Enclosure for the pitching mechanism
7 Hand grip providing the means to manually rotate the actuation lever
8 Single notch rachet mechanism coupling the hand actuator and crankshaft
9 Manual actuation lever
10 Safety gate covering ball discharge port, opens during ball passage
11 Ball support and positioning rails and safety gate actuation rails
12 Ball to be pitched
13 Threaded screw providing the means to adjust tension on the springs
14 Rigid coupling device connecting the two springs to the single tension adjustment screw
15 Linkage rods or chains between the dual tension springs and coupling
16 Resilient one-way clutch pad attached to the frame
17 Linear tension springs utilized to store and release energy during a pitch cycle
18 Crankshaft
19 Friction reducing ball bearings supporting the crankshaft
20 Friction reducing ball bearings attaching the springs to the crank of the crankshaft and the actuation rods to the ball support and safety gate actuation rails
21 Actuation rods for the ball support rails
22 Ball striker lever
23 Ball striker hammer
24 One-way clutch pawl
25 Ball discharge port
26 Ball insertion port
27 Optional multiple ball holding tray
28 Optional resilient pad on ball striking hammer face
Attachment point to a stationary frame FIG. 1 shows the preferred top discharge or over-hand pitching embodiment of the present invention for use in baseball or tennis training. A coach, parent, or fellow athlete operates this embodiment of the present invention by first inserting a ball 12 into the housing of the present invention through ball insertion port 25 then while standing adjacent to the machine manually pumping the actuation lever 9 by griping lever handle 7. Energy is added to the dual coil tension springs 17 in the mechanism as the lever handle 9 is moved downward rotating the crankshaft 18 and stretching the springs 17. Once the crankshaft 18 rotates over-center the spring energy is rapidly released as the springs 17 contract and rotate the crankshaft 18 and rigidly attached striker lever 22 and hammer 23 to effect the pitch of a ball 12.

The ball pitching mechanism of the present invention relies on symmetry and balance to reliably produce the desired ball pitching effect and for long term durability. Friction reducing ball or roller bearings 19 are employed symmetrically on each side of the centered striker lever 22 to support the crankshaft 18 about the axis of rotation and to attach the dual tension springs 17 to the crankshaft 18. The dual springs 17 are attached symmetrically to the crankshaft 18 on either side of the centered striker lever 22. Symmetrical loading and support of the crankshaft 18 prevents bending and twisting effects on the pitching mechanism of the present invention enhancing the accurate repeatability of its function as well as the durability and longevity of the device. The one-way clutch (16, 24) of the present invention is an integral part of the striker (22, 23), centered with the striker (22, 23) between the mechanism's friction reducing support bearings 19 and the dual linear tension springs 17. The one-way clutch (16, 24) allows the striker (22, 23) and crankshaft 18 to rotate only in the appropriate direction required to produce a properly pitched ball. The resilient pad 16 of the one-way clutch (16, 24) is firmly attached to the inside surface of the enclosure 6 along and just outside the arc traveled by outer end of the striker hammer 23. A pawl 24 is attached to the outer end of the striker hammer 23 and contacts the resilient clutch pad 16 during the portion of the crankshaft 18 rotation when the linear tension springs 17 are being stretched. If actuation force is released from the actuation lever 9 during this portion of the rotation, the pawl 24 engages the resilient clutch pad 16 and prevents the crankshaft 18 and attached striker lever 22 and hammer 23 from rotating back in the opposite direction.

In the present invention a push rod 21 is attached to each of the friction reducing bearings 20 which also couple the springs 17 to the crankshaft 18. These push rods 21 are utilized to actuate the ball support/safety gate actuation rods 11 which hold a ball 12 in place to be struck by the striker mechanism (22, 23) and pitched from the machine through the ball discharge port 25.

The speed of balls 12 pitched by the present invention is controlled by the characteristics of the springs 17 utilized in the mechanical pitching mechanism and by adjustment to the resting tension in the springs 17 by the ball speed adjustment nut 4. Pre-loading the springs 17 by stretching them in the resting position produces greater force in the springs 17 which results in a higher hammer 23 speed and force at ball impact to produce a faster ball pitch.

To impart back-spin on the ball 12 being pitched by the top discharge or over-hand pitching embodiment of the present invention as required to closely simulate pitches thrown by a human, the face of the hammer 23 surface string the ball 12 is angled relative to the direction of travel of the hammer 23. The angle of the hammer face relative to direction of travel of the hammer 23 at the point of impact with the ball 12 results in both spin and deflection in direction of travel in the ball.

Adjustments to the elevation angle of projection of the pitched balls from the present invention may be made by loosening the elevation hand adjustment nuts 5 and rotating the pitching mechanism enclosure 6 in the support cradle 2. The new elevation is maintained by tightening the hand adjustment nuts 5 to "clamp" and hold the pitching mechanism enclosure 6 in position to provide the desired pitch elevation angle.

I claim:

1. A sports training device for baseball, softball, or tennis practice or simple amusement which pitches by mechanical impact means either tennis balls or soft resilient safety practice balls over the same distances and with similar speeds, spins, and trajectories as encountered in actual game play comprising in combination:

a structural frame;

a ball striker lever and hammer rotatably mounted on a crankshaft, said crankshaft being supported at both ends by friction reducing roller or ball bearings attached to said structural frame, said crankshaft being mounted generally transverse to the direction of projected ball travel, said striker lever extending radially from said crankshaft, said striker hammer being attached to the outer end of said striker lever;

dual tension springs with one end attached to the crankshaft crank through friction reducing roller or ball bearings, one on each side of the striker lever, and the opposite ends of both springs attached to a tension adjustment mechanism, said tension adjustment mechanism being attached to the structural frame, said dual tension springs being situated to accumulate energy by stretching during 180 degrees of unidirectional rotation of the crankshaft then release said stored energy into the crankshaft by contracting during the second 180 degrees of unidirectional crankshaft rotation;

a ball holding and positioning mechanism consisting of parallel rods or rails situated transverse to the crankshaft axis of rotation and at a distance from said crankshaft appropriate to position a ball to be struck by the striker hammer, said ball holding and positioning rods or rails being spaced apart far enough to allow the striker lever and hammer to readily pass between them yet close enough to each other to prevent a tennis ball or larger ball from falling between them, said ball holding and positioning rods or rails being attached to the frame by pivoting axles at points generally under the ball strike position; said ball holding and positioning rods or rails being also attached to actuation rods at points forward of the pivot axles, attachment points being in the direction in which pitched balls are projected, said actuation rods being attached at the opposite end to the crankshaft crank through the friction reducing roller or ball bearings utilized to additionally attach the tension springs to the crankshaft crank;

a one-way clutch mechanism consisting of a pawl attached to the outer edge of the striker hammer and a strip of resilient material attached to a semicircular track of the frame situated slightly outside the arc traveled by the outer edge of the striker hammer and extending generally from slightly below the ball projection path around to the dual tension spring attachment point on the frame, said one-way clutch allowing rotation of the crankshaft and attached striker lever in only the appropriate direction to produce a pitched ball during the portion of crankshaft rotation when energy is being added to the springs by external actuation;

an actuation lever attached to the crankshaft through a one-way racheting mechanism, said racheting mechanism coupling the actuation lever to the crankshaft to allow rotation of the crankshaft in only the appropriate direction to produce a pitch and de-coupling the crankshaft from the actuation lever when the crank rotates over-center and is receiving energy from the stretched springs;

a safety enclosure with a ball feed port and a ball discharge port, said ball discharge port being covered with a safety gate to prevent access to the machine components, said safety gate being attached to the ball holding and positioning rods or rails and opened to allow ball discharge by movement of said ball holding and positioning rods or rails.

2. The machine of claim 1 including a portable carriage with a mechanism to allow adjustment of the pitched ball projection elevation angle.

3. The machine of claim 1 including a ball tray and feeding mechanism to conveniently hold and feed balls into the machine.

4. The machine of claim 1 including an electrically powered actuator in addition to the manual lever actuator.

* * * * *